US006870278B2

(12) United States Patent
Hnilica

(10) Patent No.: US 6,870,278 B2
(45) Date of Patent: Mar. 22, 2005

(54) STARTER FOR INTERNAL COMBUSTION ENGINES

(75) Inventor: Miloslav Hnilica, Kromeriz (CZ)

(73) Assignee: Magneton A.S., Kromeriz (CZ)

( * ) Notice: Subject to any disclaimer, the term of this patent is extended or adjusted under 35 U.S.C. 154(b) by 0 days.

(21) Appl. No.: 10/474,550

(22) PCT Filed: Nov. 19, 2001

(86) PCT No.: PCT/CZ01/00066

§ 371 (c)(1),
(2), (4) Date: Oct. 10, 2003

(87) PCT Pub. No.: WO02/081903

PCT Pub. Date: Oct. 17, 2002

(65) Prior Publication Data

US 2004/0112319 A1 Jun. 17, 2004

(30) Foreign Application Priority Data

Apr. 10, 2001 (CZ) ..... 2001-1282

(51) Int. Cl.[7] ..... F02N 11/00
(52) U.S. Cl. ..... 290/48; 74/7 R
(58) Field of Search ..... 290/48; 310/83, 310/75 R; 74/7 R

(56) References Cited

U.S. PATENT DOCUMENTS 4,852,417 A * 8/1989 Tanaka ..... 74/7 E
4,902,904 A * 2/1990 Isozumi ..... 290/48
4,970,908 A * 11/1990 Isozumi et al. ..... 74/7 E
4,978,874 A * 12/1990 Isozumi et al. ..... 310/83
5,081,874 A * 1/1992 Isozumi ..... 74/7 A
5,227,751 A * 7/1993 Shiroyama et al. ..... 335/126
5,760,487 A * 6/1998 Kimura et al. ..... 290/48
5,839,318 A * 11/1998 Kimura et al. ..... 74/7 R
6,633,099 B2 * 10/2003 Fulton et al. ..... 310/75 R

FOREIGN PATENT DOCUMENTS

DE 2624645 A1 * 12/1977
DE 3908870 A1 * 9/1989
FR 2488041 A1 * 2/1982
GB 782191 * 9/1957

* cited by examiner

*Primary Examiner*—Joseph Waks
(74) *Attorney, Agent, or Firm*—Notaro & Michalos P.C.

(57) ABSTRACT

A starter for an internal combustion engine produces less noise and has a longer life and includes a transmission element for actuating an electric motor. The transmission element has two independently coaxially seated components—a stop pin and an engaging bar. The engaging bar is positioned between a pinion of the motor and the stop pin. The stop pin is seated in an internal shoulder in a cavity of the armature shaft of the electric motor and through the shoulder of a fixed core. A narrow portion of the stop pin is seated in an engaging spring positioned in the cavity of a mobile core of a disengaging electromagnet. The stop pin bears with a second front surface against a washer secured in the mobile core, where the length of the mobile core cavity is greater than the length of the narrow part of the stop pin by a predetermined distance c.

6 Claims, 2 Drawing Sheets

STARTER FOR INTERNAL COMBUSTION ENGINES

FIELD AND BACKGROUND OF THE INVENTION

This invention relates to a starter of internal combustion engines, and in particular a car's internal combustion engine starter with a disengaging pinion, electromagnetically disengaged to interact with the gear rim of the internal combustion engine.

Internal combustion engine starters are designed so that the disengaging pinion is disengaged to interact with the gear rim of the internal combustion engine through the action of a magnet core onto the pinion or frequently through a two-armed lever, and the magnet is situated outside the electric motor axis with the pinion so that their axes are parallel.

Another well known solution is when a disengaging magnet is situated on the pinion axis of the starter but the electric motor is situated in a position parallel thereto. In these starter embodiments the design of the electric motor includes an internal gearing with ferrite permanent magnets working at high speed and reducing the electric motor speed to the necessary pinion speed by the engagement of pinion teeth with gear rim teeth. This gearing is carried in the electric motor axis in the case of a planet solution, or in the pinion axis if this gearing is not situated on the electric motor axis.

U.S. Pat. No. 5,081,874 teaches a design solution for a starter, in which the pinion is engaged with a gear rim of an internal combustion engine through a transmission element formed by one disengaging bar inserted in an armature shaft cavity. This disengaging bar forms a dynamic unit with the mobile core of a disengaging electromagnet. If, upon pinion disengagement, the pinion teeth are striking the rim teeth of the internal combustion engine, the motion of the mobile core and the coupled disengaging bars will not stop, and a shooting spring inserted into the mobile core is compressed until the moment when the pinion tooth engages into the space of the gear rim tooth of the internal combustion engine. Because full current is already brought into the armature, and the pinion is rotating at its full output, the pinion will be intensively shot into the gear rim of the internal combustion engine, which is connected with spokes, and causing a great wear on the pinion teeth and gear rim teeth of the internal combustion engine. Another disadvantage of this U.S. patent is the necessity to secure the ball inserted between the pinion end and the engaging bar. This ball is inserted to inhibit the transmission of pinion rotative motion onto the mobile core upon spring compression, when a full output is already brought into the armature. Ball securement between the pinion end and the disengaging bar is very questionable, because the ball can easily drop out as a result of great dynamic strokes originating upon pinion engagement into the gear rim of the internal combustion engine.

A common disadvantage of these starter solutions is the wear on the pinion teeth and the flywheel gear rim teeth. Pinion teeth are inserted into the flywheel gear rim teeth. A shooting spring is applied at the striking of the pinion tooth into the flywheel gear rim tooth of the internal combustion engine. The shooting spring forcefully shoots the pinion at full torsional moment of the armature into the flywheel gear rim teeth.

Another disadvantage of all these above described solutions is complexity, and relative corresponding lower working reliability. Another disadvantage of all these solutions is the limited position of the assembly in the internal combustion engine. A disadvantage of starters with gears is also high noise upon starting due to its high speed function.

SUMMARY OF THE INVENTION

The present invention comprises of an improved starter for internal combustion engines having an electric motor stator with permanent magnets of the electric motor armature, a front cover, and a rear cover, in which is situated a disengaging electromagnet with a mobile core, and contacts for connection to a bridge. A pinion comes out from the front cover. The pinion is slidingly situated in the cavity of electric motor armature shaft, and is operated by a transmission element through the mobile core of the disengaging electromagnet. The transmission element consists of two independently co-axially situated parts, from which the first part is formed by an engaging bar, and the second part is formed by a stop pin. The engaging bar is situated between the pinion end and the stop pin, and is led through the internal shoulder in the cavity of the armature shaft of the electric motor to be placed in fixed core. This engaging bar is not coupled in motion with the mobile core of the disengaging electromagnet and of the pinion. The stop pin has a narrow portion and is situated with its narrow portion placed in the engaging spring adapted in the cavity of the mobile core of disengaging electromagnet. The engaging spring has a first side that bears against the first front surface of the stop pin and a second side which bears against the cavity bottom of mobile core of disengaging electromagnet.

The stop pin with its second front surface bears against the washer secured in the mobile core of disengaging electromagnet. Upon pinion engagement into the gear rim of the internal combustion engine, if pinion teeth are bumped into the gear rim teeth, the engaging bar acts against the motion of the stop pin, and the ending stop surface bears against the cavity bottom of mobile core, thus stopping its motion. As a result, the contacts with the bridge cannot switch before pinion engagement into the gear rim and in this way it will energize full torsional moment of the armature, and it will rotate the pinion with its full output. This is secured so that cavity length of the mobile core is greater by a predetermined distance than is the length of a narrow portion of the stop pin. A return spring is situated between the fixed core and the mobile core of the disengaging electromagnet.

To prevent a strong bearing of the mobile core onto the bearing surface of the rear shield of the rear cover at the back motion of the mobile core of the disengaging electromagnet, the mobile core bears through an insulation bushing, and bears the contact spring against the internal surface of the shield of the rear cover. A space is created between the washer of the mobile core and the internal surface of the cover. This space should be identical to the space between the insulation bushing and the insulating washer of the bridge.

One advantage of the bar is that it is made from non-magnetic material and is advantageously moulding from plastic. To create a reduced torsional moment of the armature at pinion engagement before the switching of contacts with the bridge, it is advantageous to create the stator magnets from NdFeB material.

The main advantage of the invention is that at the striking of the pinion tooth onto the gear rim tooth of the internal combustion engine, the motion of the mobile core is stopped, wherein the spring inserted in the mobile core is not compressed. Thus, the contacts with bridge will not be switched instantaneously, and in this way the full torsional moment of the armature is achieved and the pinion is rotated to full output before its engagement with the gear rim of the internal combustion engine. Only at the moment, when the pinion teeth will rotate on the gear rim teeth, and the pinion is engaged into gear rim of internal combustion engine, contacts with the bridge are switched, and the pinion is rotated in full output. The pinion is carefully engaged into the gear rim of the internal combustion engine, which is manifested by low noise, and by longer life of the pinion, and the gear rim teeth. In this way the noise at strokes of pinion teeth onto gear rim teeth is reduced. Utilizing a freely seated bar for the transfer of axial force from the mobile core of disengaging electromagnet onto the pinion simplifies the whole design of the engaging mechanism.

BRIEF DESCRIPTION OF THE DRAWINGS

The presented invention will be explained in detail according to the following technical description, which is elaborated according to enclosed drawings, in which.

DESCRIPTION OF THE PREFERRED EMBODIMENTS

Figure 1:
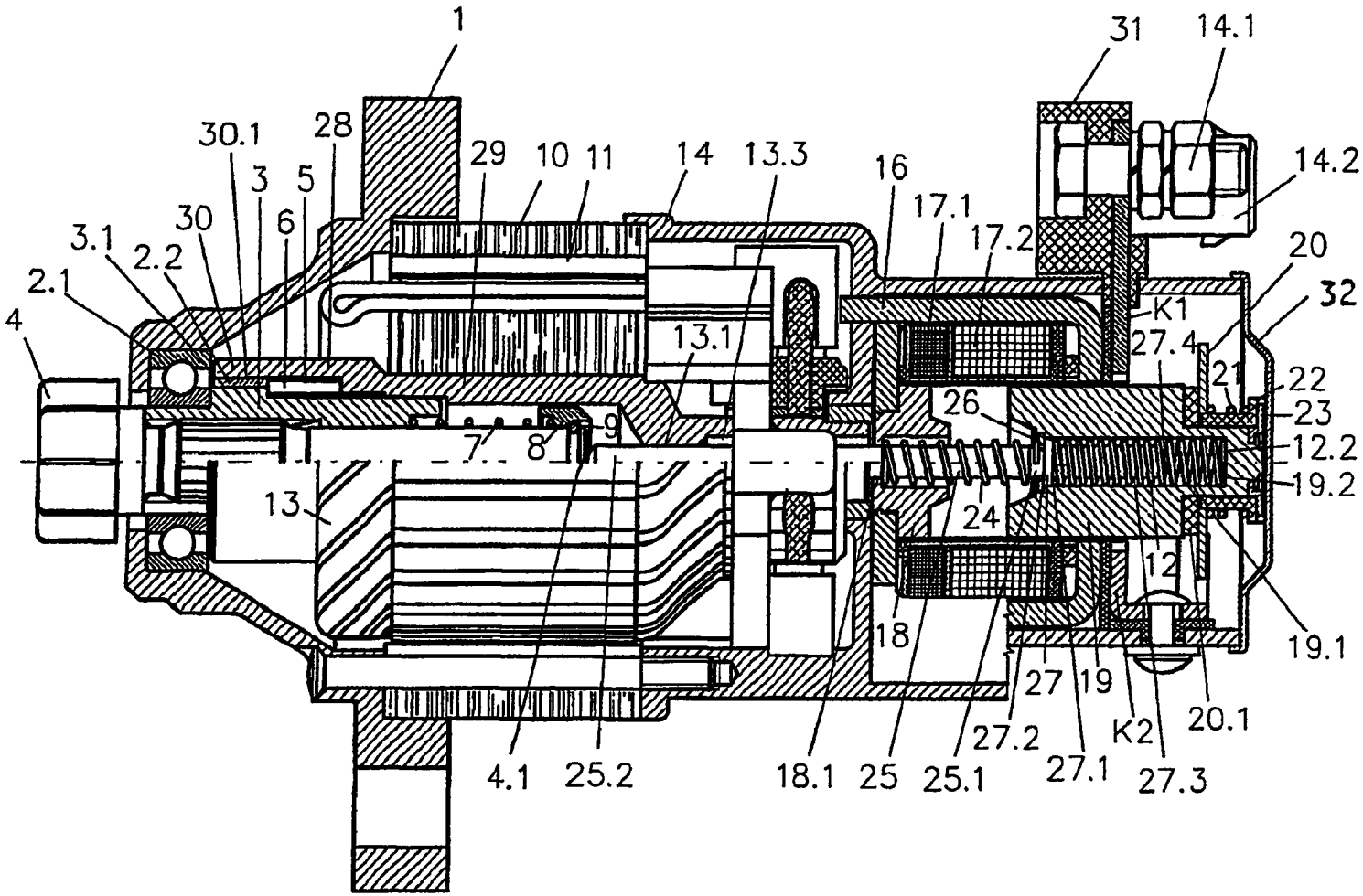
FIG. 1 represents a section through the starter.
Figure 2:
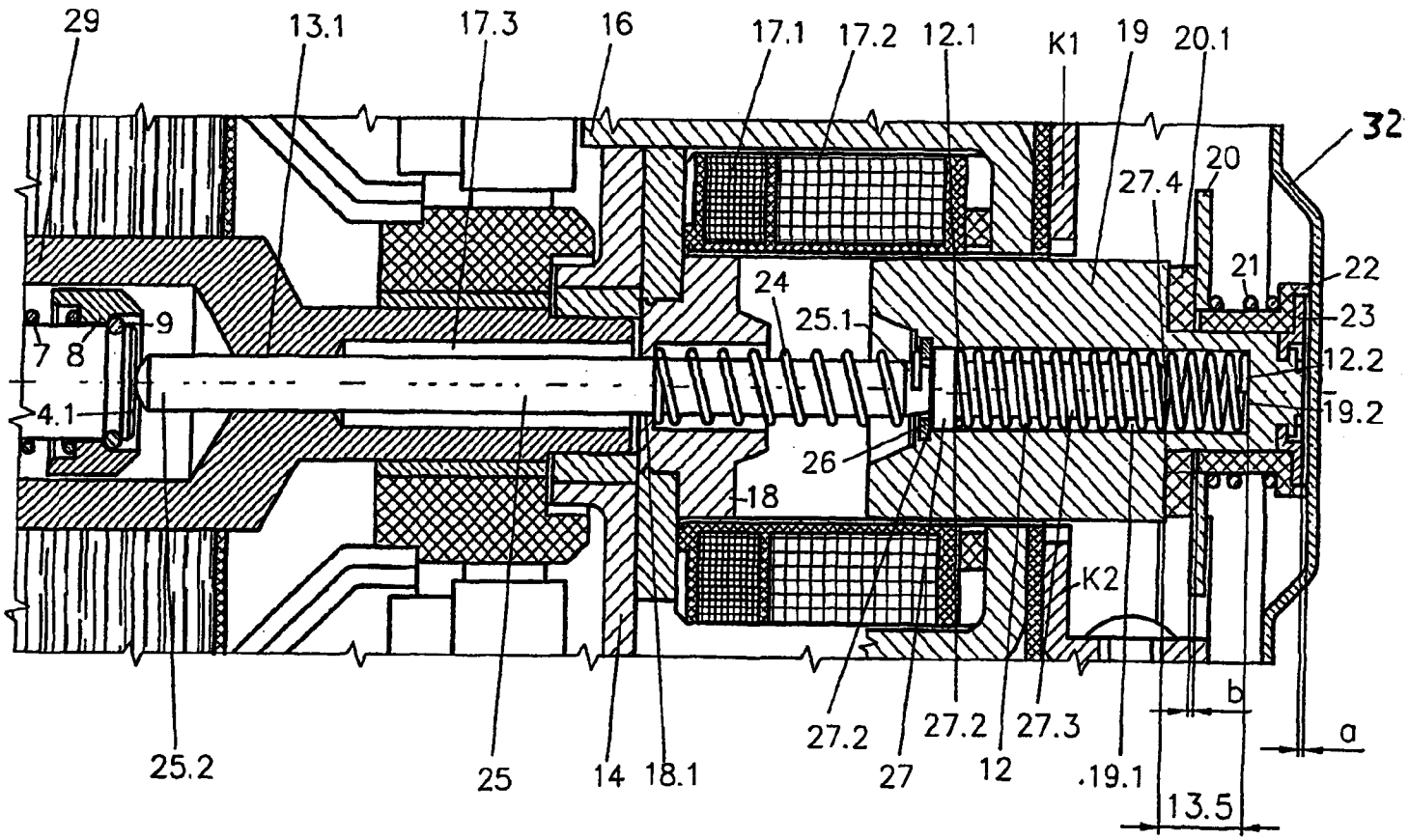
FIG. 2 represents a section through the starter according to FIG. 1 with the seating of the disengaging electromagnet, disengaging bar, and pinion end part.

The starter according to FIGS. 1 and 2 consists of an electric motor for producing a turning moment, a stator 10 of the electric motor containing permanent magnets 11 made from material with high remanence, and coercivity, e.g. NdFeB. The starter also consists of a front cover 1, and a rear cover 14. In rear cover 14 a disengaging electromagnet 16 is seated and contains a fixed core 18, mobile core 19, retaining winding 17.1, and retracting winding 17.2. Contacts K1 and K2 are also embedded in the rear cover 14 for connection with the bridge 20, and its brush supports. A pinion 4 projects from the front cover and is slidingly seated in a cavity 13.3 of the shaft 29 of an armature 13 of the electric motor. The pinion 4 has a return spring 7 at end 4.1, which is embedded between stop ring 8 and engagement bushing 3 of overrunning clutch 28. The overrunning clutch 28 is seated in the end of the shaft 29 of the armature 13 of the electric motor, and contains rollers 5 and springs 6. The stop ring 8 is secured by a retaining ring 9, which is secured at end 4.1 of the pinion 4. The extended end 30 of the overrunning clutch 28 and its internal cylindrical diameter 30.1 are seated on external extended part 3.1 of engagement bushing 3 through the bearing 2.2. The end of engagement bushing 3 is led through a ball bearing 2.1 embedded in the front cover 1. Pinion 4, armature 13 and disengaging electromagnet 16 are arranged in their mutual position on one axis. Pinion 4 is actuated by engagement with a flywheel gear rim (not shown) of the internal combustion engine, through a transmission element consisting of two independently seated parts, from which the first part is engaging bar 25, and the second part is stop pin 27. The engaging bar 25 is embedded between the end 4.1 of pinion 4 and stop pin 27. On the side of the pinion 4, the bar 25 is led through internal shoulder 13.1 in the cavity 13.3 of the shaft 29 of the armature 13 of the electric motor, and on the side of disengaging electromagnet 16 it is led through the shoulder 18.1 in fixed core 18. This engaging bar 25 is not connected in motion with the mobile core 19 of the disengaging electromagnet 16, and also of pinion 4. The engaging bar 25 is made from non-magnetic material, with the advantage of a plastic moulding. Stop pin 27 has a narrow portion 27.3 and is embedded in engaging spring 12 adapted in the cavity 19.1 of mobile core 19 of disengaging electromagnet 16. The engaging spring 12 has a first side 12.1 which bears against the first front surface 27.1 of stop pin 27 with return spring 24, and a second side 12.2, which bears against the bottom 19.2 of the cavity 19.1 of mobile core 19 of disengaging electromagnet 16. Stop pin 27 has a second front surface 27.2, which bears against the washer 26 secured in mobile core 19. A preset distance c (shown at 13.5) lies between the end surface 27.4 of the narrow portion 27.3 of the stop pin 27, and the bottom 19.2 of the cavity 19.1 of mobile core 19 of disengaging electromagnet 16. This preset distance c prevents the switching of the bridge 20 with contacts K1 and K2 before the engagement of the pinion 4 into the gear rim of the internal combustion engine. The preset distance c is calculated as the difference between the length of cavity 19.1 of mobile core 19, and the length of narrow portion 0.27.3 of the stop pin 27. The length of cavity 19.1 of the mobile core 19 is measured between the front surface 27.1 of stop pin 27, and the bottom 19.2 of mobile core 19.

The mobile core 19 of disengaging electromagnet 16 bears against the internal surface of the cover 32 through insulation bushing 22, and contact spring 21, which closes the rear cover 14. A space a lies between the insulation bushing 22 of mobile core 19 of disengaging electromagnet 16, and the internal surface of the cover 32, which is as great as space b between the insulation bushing 22, and the insulation washer 20.1 of the bridge 20. Spaces a and b prevent a strong bearing of the mobile core 19 of disengaging electromagnet 16 against the surface of the shield or cover 32 of rear cover 14 at the back motion of the pinion 4 from the gear rim of internal combustion engine. In the rear part of the rear cover 14, a terminal board 31 is connected to contact K1 and is embedded with an outlet 14.1 made with the screw on accumulator battery, and an outlet 14.2 of retaining winding 17.1 and retracting winding 17.2 connected to a start push button or switching box with a start position (not shown).

After current is fed through the retracting winding 17.2 into the armature 13 of electric motor, and the motor rotates due to the action of the permanent magnets 11, the rotative motion is transferred through overrunning clutch 28, and through engagement bushing 3 onto the pinion 4, which is slidingly connected with the engagement bushing 3. At the same time an axial motion of the mobile core 19 with the engaging spring 12 begins, which pushes the stop pin 27 to the first end 25.1 of the engaging bar 25 through the washer 26. The second end 25.2 of the engaging bar 25 is pushed with its rounded end to the end 4.1 of the pinion 4. In the case that the tooth of the pinion 4 is oriented into tooth space of the gear rim of the internal combustion engine, the mobile core 19 with the engaging bar 25 continues its motion an the pinion 4 is engaged into interaction with the gear rim of the internal combustion engine through the pushing of the engaging bar. At this moment, contacts K1 and K2 are switched with the bridge 20, and also the current to the electric motor of the starter, and the rotation of the pinion 4 are interconnected through a full torsional moment. Thus, the starter is put into operation. At the back motion of mobile core 19, when the pinion 4 is disengaged from the gear rim of the internal combustion engine, the insulation bushing 22 will bear against the internal surface of the cover 32. The mobile core 19 further continues the motion, and at the same time, the contact spring 21 is compressed up to the phase, when the securing washer 23 overcomes the distance a, or the distance b, and it will also bear against the internal surface of the cover 32. In this way, the stroke of the mobile core 19 is dampened in its back motion.

In the case, that within the disengagement of the pinion 4, its tooth will impact the tooth of the gear rim (not shown) of the internal combustion engine, the engaging spring 12 dampens the impact of the pinion 4 onto the gear rim, and freely moving engaging bar 25 is acting against the motion of the stop pin 27, the end stop surface 27.4 of which will bear against the bottom 19.2 of the cavity 19.1 of the mobile core 19. At this moment, the axial motion of the pinion 4, and also of the stop pin 27 is stopped. At the same time the compression of the engaging spring 12 is stopped as well. The difference between the length of the cavity 19.1 of the mobile core 19, and the narrow portion 27.3 of the stop pin 27 (free distance c) will prevent the switching of contacts K1 and K2 with the bridge 20 before the engagement of the pinion 4 into the gear rim of internal combustion engine, and in this way the pinion 4 will be rotated in full torsional moment. At the moment of the stroke of its teeth onto teeth of gear rim of internal combustion engine, the pinion 4 is rotated at reduced torsional moment of the armature 10 of electric motor. As soon as teeth of the pinion 4 rotate on gear rim of internal combustion engine into the position, in which is facilitated the engagement of the pinion 4 into gear rim of internal combustion engine, the engaging spring 12 through stop pin 27, and the engaging bar 25 carefully engage the pinion 4 into teeth of gear rim of internal combustion engine. Afterwards contacts K1 and K2 with the bridge 20 are interconnected, and in this way the stream circuit of electric motor of the starter, and the rotation of the pinion 4 in full torsional output are interconnected. The starter is put into operation according to the procedure described above.

At the back motion of the mobile core 19, when the pinion 4 is disengaged from the gear rim of internal combustion engine, the insulation bushing 22 will bear against the internal surface of the cover 32, the mobile core 19 further continues its motion, and a the same time the contact spring 21 is compressed up to the phase, when securing washer 23 overcomes the distance a, if the case may be b, and also it will bear against the internal surface of the cover 32. In this way the stroke of the mobile core 19 will be attenuated at the back motion.

What is claimed is:

1. A starter for an internal combustion engine comprising:

a front cover (1) and a rear cover (14);

a motor mounted between the front and rear covers, the motor having a stator (10) with permanent magnets (11) and an armature (13) having shaft (29) with a first cavity (13.3);

a disengaging electromagnet (16) containing a fixed core (18), a mobile core (19) which defines a second cavity (19.1), and contacts (K1, K2) for connection with a bridge 20;

an engaging spring (12) adapted in said second cavity (19.1) and having a first side (12.1) and a second side (12.2);

a return spring (24) situated between the fixed core (18) and the mobile core (19);

a pinion (4) projecting from the front cover (1), which is slidingly seated in said first cavity (13.3), and which is actuated by a transmission element through the mobile core (19), said transmission element consisting of two independently coaxially seated parts, one of said parts being an engaging bar (25), and another of said parts being a stop pin (27) having a narrow portion (27.3) within said engaging spring (12), the engaging bar (25) being positioned between an end (4.1) of the pinion (4) and the stop pin (27), and being led through an internal shoulder (13.1) in the first cavity (13.3) and through a shoulder (18.1) in said fixed core (18);

the second cavity (19.1) being longer by a preset distance (13.5), than the narrow portion (27.3), wherein said preset distance (13.5) prevents the switching of the bridge (20) with contacts (K1) and (K2) before the engagement of the pinion (4) into a gear rim of the internal combustion engine;

and the engaging spring (12) bearing with said first side (12.1) against a first front surface (27.1) of the stop pin (27), and bearing with said second side (12.2) against a cavity bottom (19.2) of the second cavity (19.1), and said stop pin (27) bearing with its second front surface (27.2) against a washer (26) secured in the mobile core (19).

2. A starter according to claim 1, wherein the mobile core (19) bears against the internal surface of a shield (32) of the rear cover (14) through an insulation bushing (22) and a contact spring (21), and a space (a) is between the insulation bushing (22) of the mobile core (19) and the internal surface of the shield (32) which is as long as a space (b) between said insulation bushing (22) and an insulation washer (20.1) of said bridge (20).

3. A starter according to claim 1, wherein a terminal board (31) is interconnected to one of said contacts (K1) and is situated in an outlet (14.1) of the rear cover (14).

4. A starter according to claim 1, wherein the engaging bar (25) is made from non-magnetic material.

5. A starter according to claim 1, wherein the engaging bar (25) is made from plastic material.

6. A starter according to claim 1, wherein permanent magnets of the stator (10) are made from NdFeB.

* * * * *